US007445494B2

(12) United States Patent
Wei et al.

(10) Patent No.: US 7,445,494 B2
(45) Date of Patent: Nov. 4, 2008

(54) ELECTRICAL CONNECTOR WITH RETAINING MEMBER

(75) Inventors: Ti-Li Wei, Tu-Cheng (TW); Guo-Jiun Shiu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/656,076

(22) Filed: Jan. 22, 2007

(65) Prior Publication Data

US 2007/0173107 A1 Jul. 26, 2007

(30) Foreign Application Priority Data

Jan. 20, 2006 (TW) ..... 95201397 U

(51) Int. Cl.
*H01R 12/24* (2006.01)

(52) U.S. Cl. ..... 439/495

(58) Field of Classification Search ..... 439/260, 439/495

See application file for complete search history.

(56) References Cited

U.S. PATENT DOCUMENTS 5,934,932 A * 8/1999 Ito ..... 439/495
6,280,240 B1 8/2001 Chang
6,475,026 B1 * 11/2002 Tseng et al. ..... 439/495
7,094,093 B2 * 8/2006 Nakano et al. ..... 439/495
7,097,496 B2 * 8/2006 Zhang et al. ..... 439/495
7,255,584 B2 * 8/2007 Takashita ..... 439/260
2005/0287865 A1 * 12/2005 Wang et al. ..... 439/495
2006/0105621 A1 * 5/2006 Zhang et al. ..... 439/495

FOREIGN PATENT DOCUMENTS

CN 2445464 8/2001

* cited by examiner

*Primary Examiner*—Gary F. Paumen
(74) *Attorney, Agent, or Firm*—Wei Te Chung

(57) ABSTRACT

An electrical connector for connecting a sheet-like connection member (5) comprises an insulative housing (1) defining an insertion cavity (10); a plurality of conductive terminals (2) disposed in the housing and each terminal having a contact beam (211, 221) with a contact portion (210, 220) exposed to the insertion cavity; and a pressing member (3) associated with the housing and movable between an opened position and a closed position. The electrical connector further comprises a retaining member (4, 100) defining a latching surface (440, 1001). When the pressing member is shifted into the closed position, the sheet-like connection member is not only blocked by the latching surface but also retained by the pressing member and contact portions of the conductive terminals.

14 Claims, 8 Drawing Sheets

ELECTRICAL CONNECTOR WITH RETAINING MEMBER

BACKGROUND OF THE INVENTION

1. Field of the Invention

The present invention relates to an electrical connector, and more particularly to an electrical connector for a sheet-like connection member such as a flexible printed circuit or a flexible flat cable.

2. Description of Related Art

U.S. Pat. No. 6,280,240 discloses a conventional connector adapted for connecting a flexible printed circuit (FPC). The electrical connector includes a housing having an insertion cavity for receiving the FPC, a plurality of conductive terminals disposed in the housing side by side along a longitudinal direction and a pressing member which is movable between an opened position and a closed position along an insertion direction of the FPC. A pair of board locks are provided on longwise ends of the housing. Each board lock has a latching portion for blocking the pressing member breaking away from the housing, a solder portion for soldering the connector to a printed circuit board and a retention portion for frictionally securing the board lock onto the housing. The pressing member has a tongue plate and a pair of latching arms extending along the tongue plate for latching with the latching portions of the board locks. When the FPC is assembled into the insertion cavity, the pressing member is shifted from opened position to the closed position. Meanwhile, the tongue plate urges the FPC to electrically connect with contact portions of the conductive terminals. That is, the FPC is held in the insertion cavity by the tongue plate and contact portions. However, this configuration of the electrical connector makes the sheet-like connection member easily departing away its proper position when the sheet-like connection member suffers from some unrespectable external forces during transporting or using or other applications.

Therefore, a new connector is desired to overcome the disadvantage of the prior art connector.

SUMMARY OF THE INVENTION

An object of the present invention is to provide an electrical connector with a retaining member which can stably retain a sheet-like connection member therein.

In order to achieve the above-mentioned object, an electrical connector for a sheet-like connection member in accordance with the present invention is provided. The electrical connector comprises an isolative housing defining an insertion cavity extending along a longitudinal direction of the housing; a plurality of conductive terminals disposed in the housing and each terminal having a contact beam with a contact portion exposed to the insertion cavity; and a pressing member associated with the housing and movable between an opened position where the sheet-like connection is permitted to be inserted into the insertion cavity and a closed position where the pressing member urges the sheet-like connection member to electrically connect with the contact portions of the terminals. The electrical connector further comprises a retaining member defining a latching surface. When the pressing member is shifted into the closed position, the sheet-like connection member is not only retained by the pressing member and contact portions of the conductive terminals but also blocked by the latching surface.

Other objects, advantages and novel features of the present invention will become more apparent from the following detailed description of the present embodiment when taken in conjunction with the accompanying drawings.

BRIEF DESCRIPTION OF THE DRAWINGS

FIG. 7 is a perspective view of a plurality of conductive terminals and the sheet-like connection member, intending to show the electrical connection status there between;

DETAILED DESCRIPTION OF THE INVENTION

Figure 1:
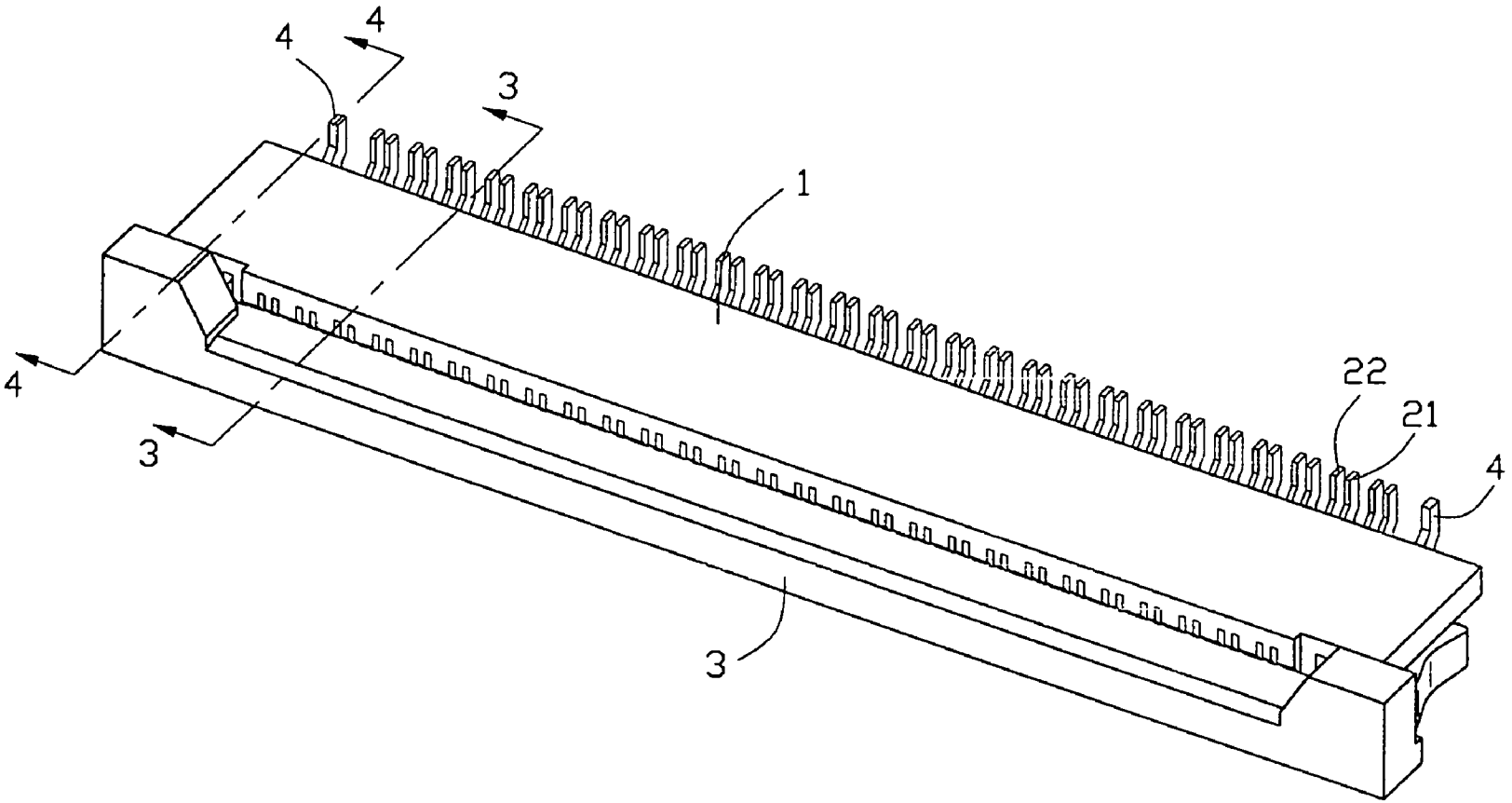
FIG. 1 is an assembled perspective view of an electrical connector in accordance with the present invention.

Reference will now be made to the drawing figures to describe the preferred embodiment of the present invention in detail.

Figure 8:
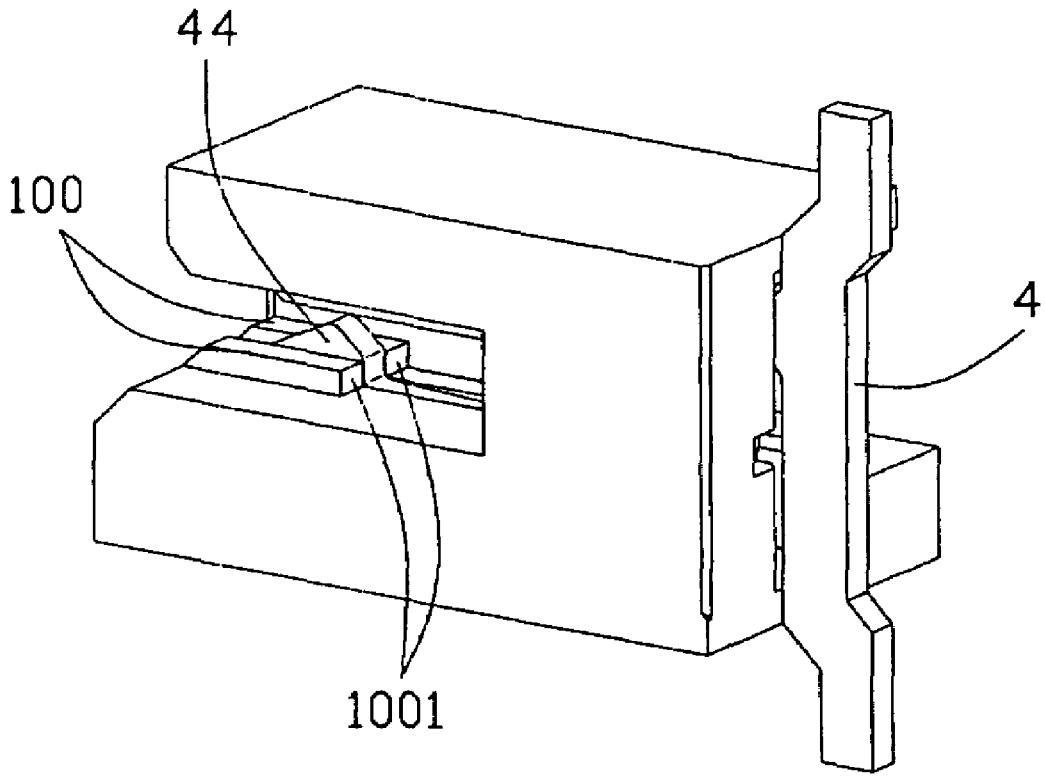
FIG. 8 is a perspective view of a portion of the electrical connector, intending to show the configurations of retaining tubers and a latching member.

Referring to FIGS. 1 and 8, an electrical connector for connecting a sheet-like connection member 5 with a printed circuit board (PCB) in accordance with the present invention is provided. The electrical connector comprises an isolative housing 1, a plurality of conductive terminals 2 disposed in the housing 1, a pressing member 3 and a pair of latching members 4.

Figure 2:
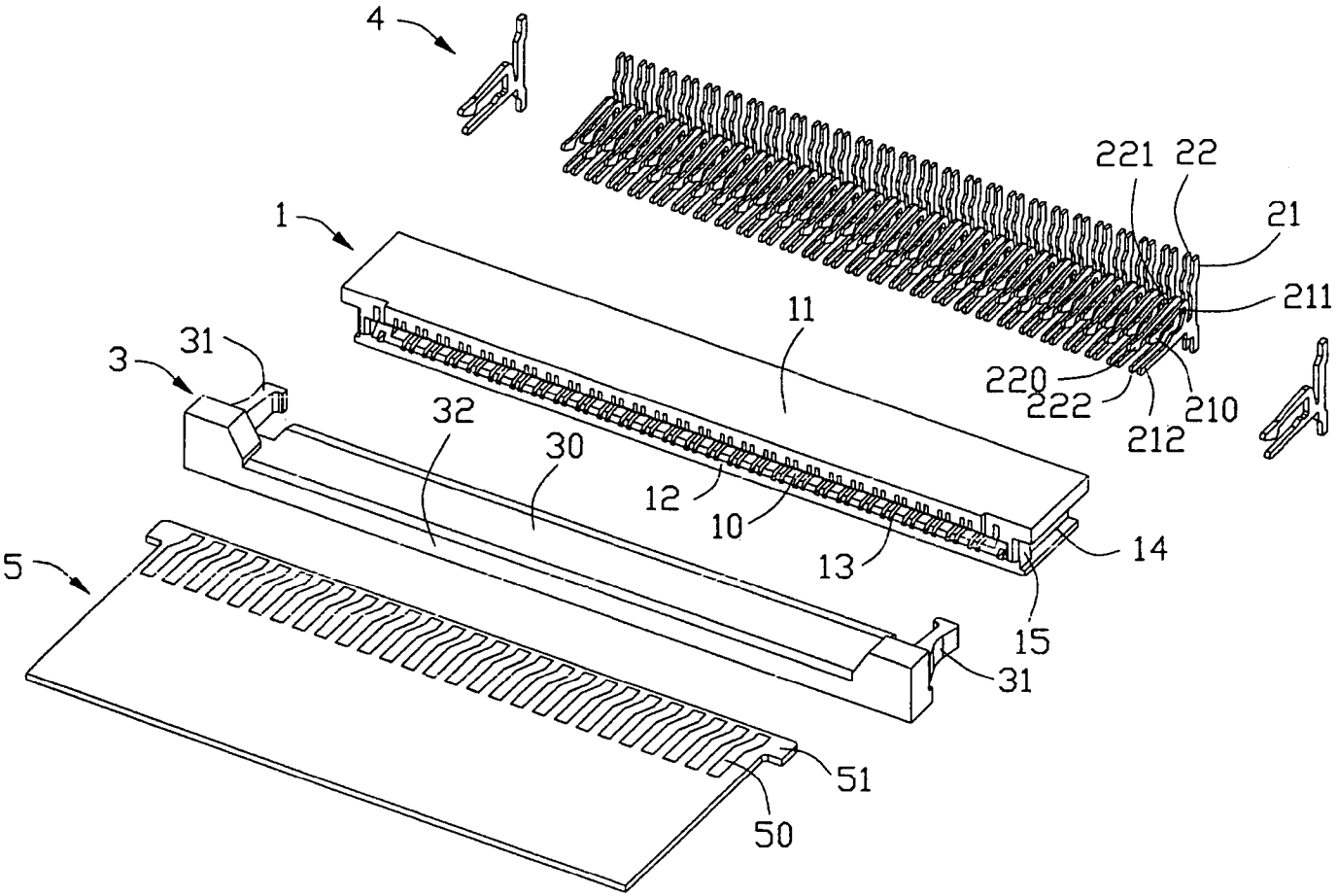
FIG. 2 is an exploded perspective view of the electrical connector shown in FIG. 1.

Referring to FIG. 2, the housing 1 is provided with a inserting cavity 10 for receiving the sheet-like connection member 5 therein. The inserting cavity 10 is surrounded by an upper wall 11, a lower wall 12 and a pair of lateral walls connecting the upper and lower walls together. Each lateral wall has a sliding channel 14 exposed outwardly to exterior and a projection 15 formed at a front end of the sliding channel 14. The housing 1 is further provided with many pairs of terminal channels 13 which are communication with the inserting cavity 10, and the distance between every pair terminal channels 13 is shorter than that between two adjacent terminal channels 13 respectively belonging to adjacent pairs. Said terminals 2 are retained in corresponding terminals channels 13.

Each terminal 2 comprises a contact beam 211, 221 having a contact portion 210, 220 at a front end thereof exposed to the inserting cavity 10 for electrically contact with the sheet-like connection member 5; a retention beam 212, 222 extending substantially parallel to the contact beam 211, 221 and frictionally retained in the housing 1 and a solder portion extending rearward from rear ends of the retention beam 212, 222 to connect to a printed circuit board. In this embodiment, the conductive terminals 2 are divided into first terminals 21 and second terminals 22. The main difference between the first and second terminals is that the length of the contact beam 221 of the first terminal 22 is a little longer than that of the contact beam 211 of the second terminals 21. Of course, the terminals 2 are also configured in other types according to demand.

The pressing member 3 has a tongue plate 30 for urging the sheet-like connection member 5 to electrically connect with the contact portions 210, 220, a pair of latching arms 31 respectively located lateral sides of the tongue plate 30 and a base plate 32 connecting the tongue plate 30 and the pair of latching arms 31 together. Each latching arms 31 has a latch at its distal end. Further referring to FIGS. 5 and 6, the pressing member 3 is shifted from an open position where the latching arms 31 latches on corresponding lateral walls of the housing 1 via the engagement between the latches and the projections 15 and the sheet-like connection member 5 is permitted to be inserted in the insertion cavity 10 to a closed portion where the tongue plate 30 urges the contact portions 210, 220 to connect with sheet-like connection member 5.

Figure 4:
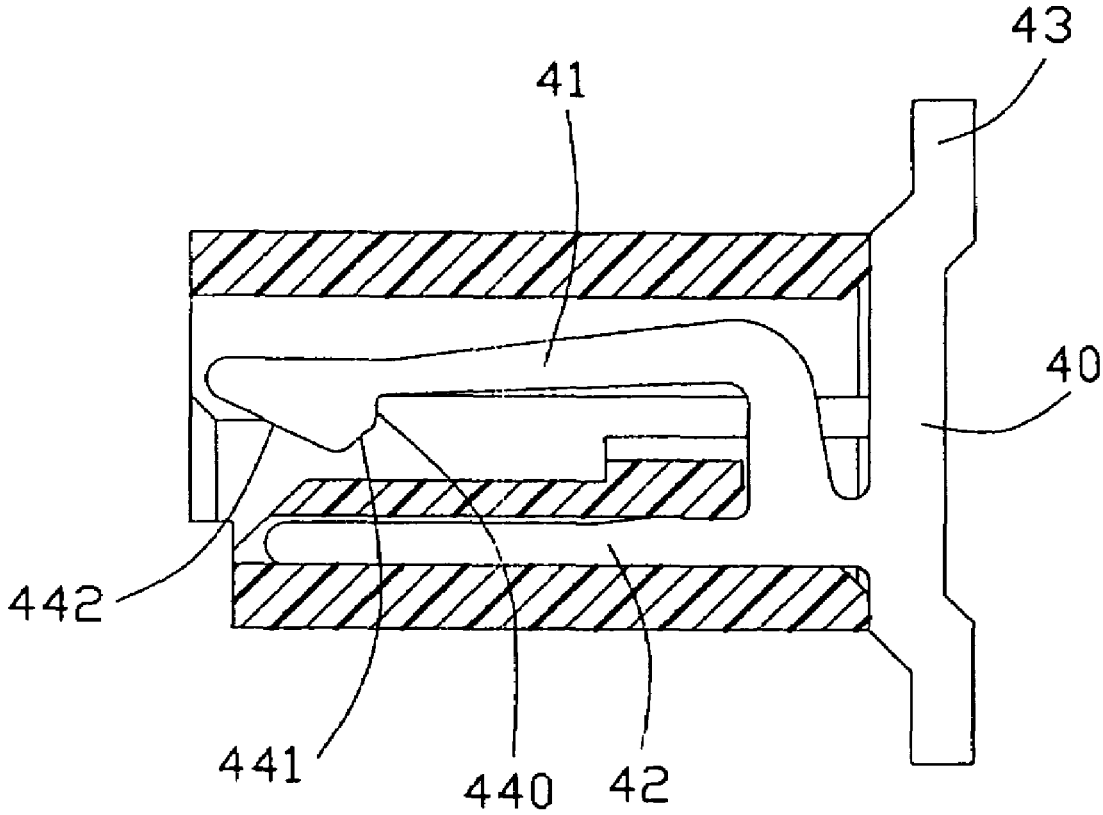
FIG. 4 is a cross-sectional view of FIG. 1 taken along line 4-4, wherein a pressing member is removed.
Figure 5:
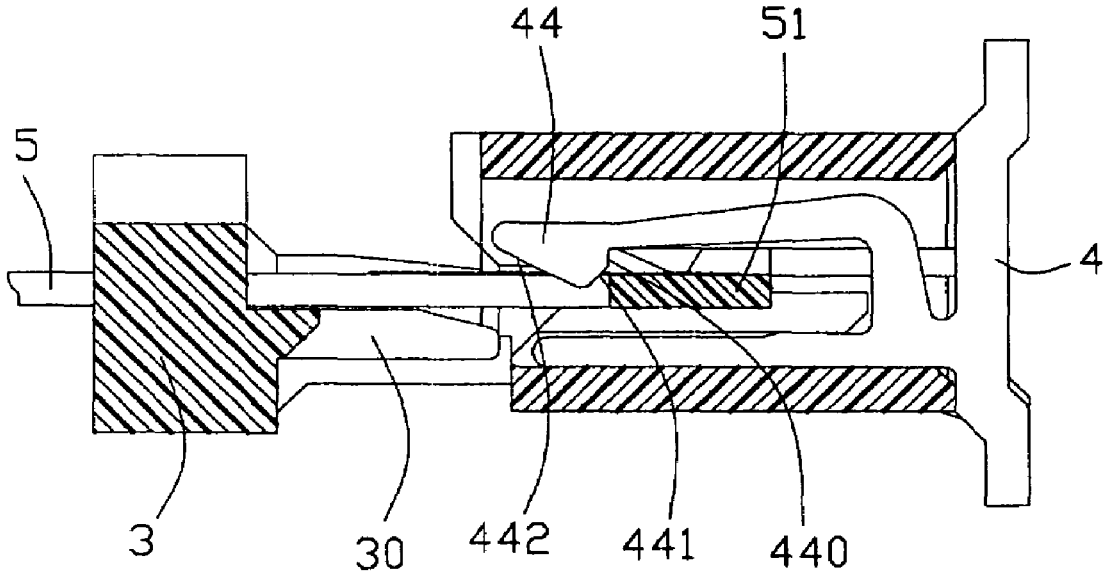
FIG. 5 is a cross-sectional view of FIG. 1 taken along line 4-4, showing a sheet-like connection member inserted and the pressing member placed in an opened position.

Referring to FIGS. 2, 4 and 5, each said latching member 4 comprises a main portion 40, a retention beam 42 extending perpendicular to the main portion 40 to be frictionally secured in the lower wall 12 of the housing 1, a latching beam 41 branching from retention beam 42 and extending substantially parallel to the retention beam 42 to be received in the upper wall 11 of the housing 1. The latching beam 41 has a projection 44 at front end thereof for retaining the sheet-like connection member 4 in the inserting cavity 10. The projection 44 defines a latching surface 440 perpendicular to an insertion direction of the sheet-like connection member 4, a first guiding surface 441 which is formed at an obtuse angle to the latching surface 440 for facilitating the sheet-like connection member 4 being removed out of the housing 1 and a second guiding surface 442 formed at a certain angle to the first guiding surface 441 for facilitating the sheet-like connection member 4 being inserted into the housing 1.

The sheet-like connection member 4 has a plurality of contact pads 50 arranged side by side in the longitudinal direction perpendicular to the insertion direction at rear portion thereof and a pair of protrusions 51 extending outward in the longitudinal direction from its lateral edges.

Figure 3:
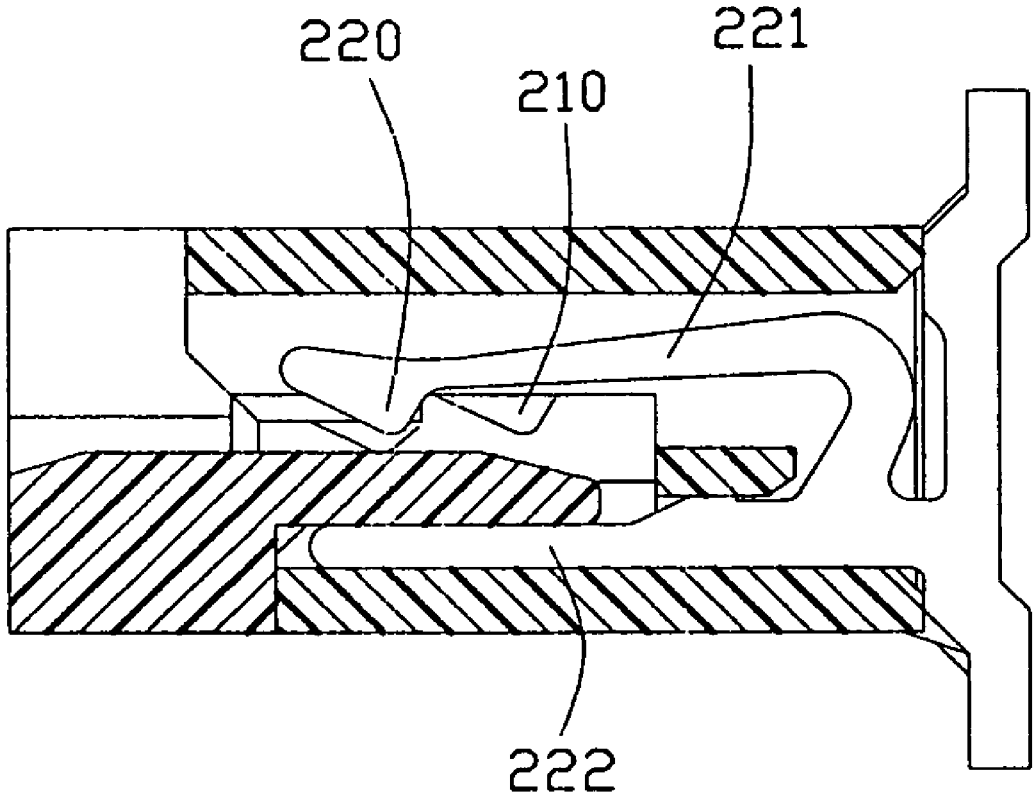
FIG. 3 is a cross-sectional view of FIG. 1 taken along line 3-3.
Figure 6:
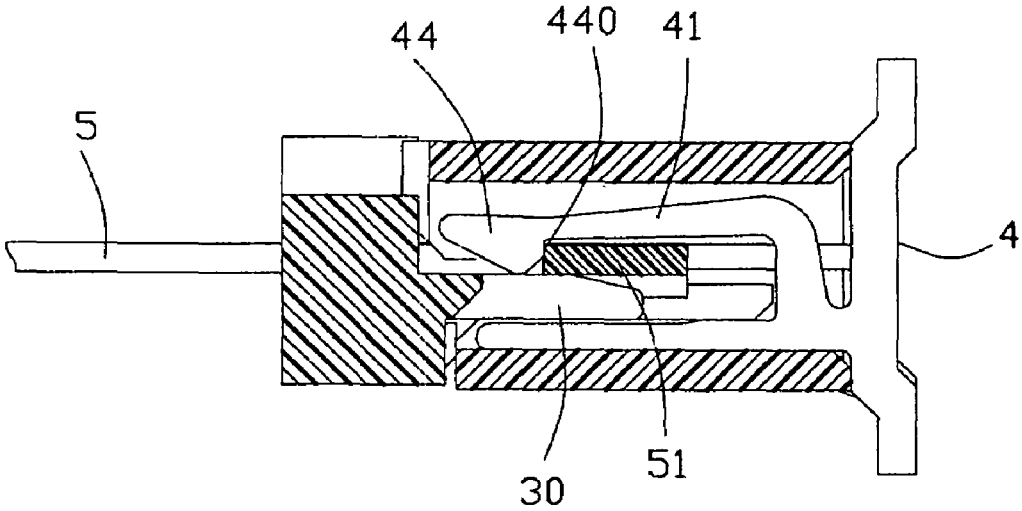
FIG. 6 is a similar view of FIG. 5, but the pressing member is placed in a closed position.
Figure 7:
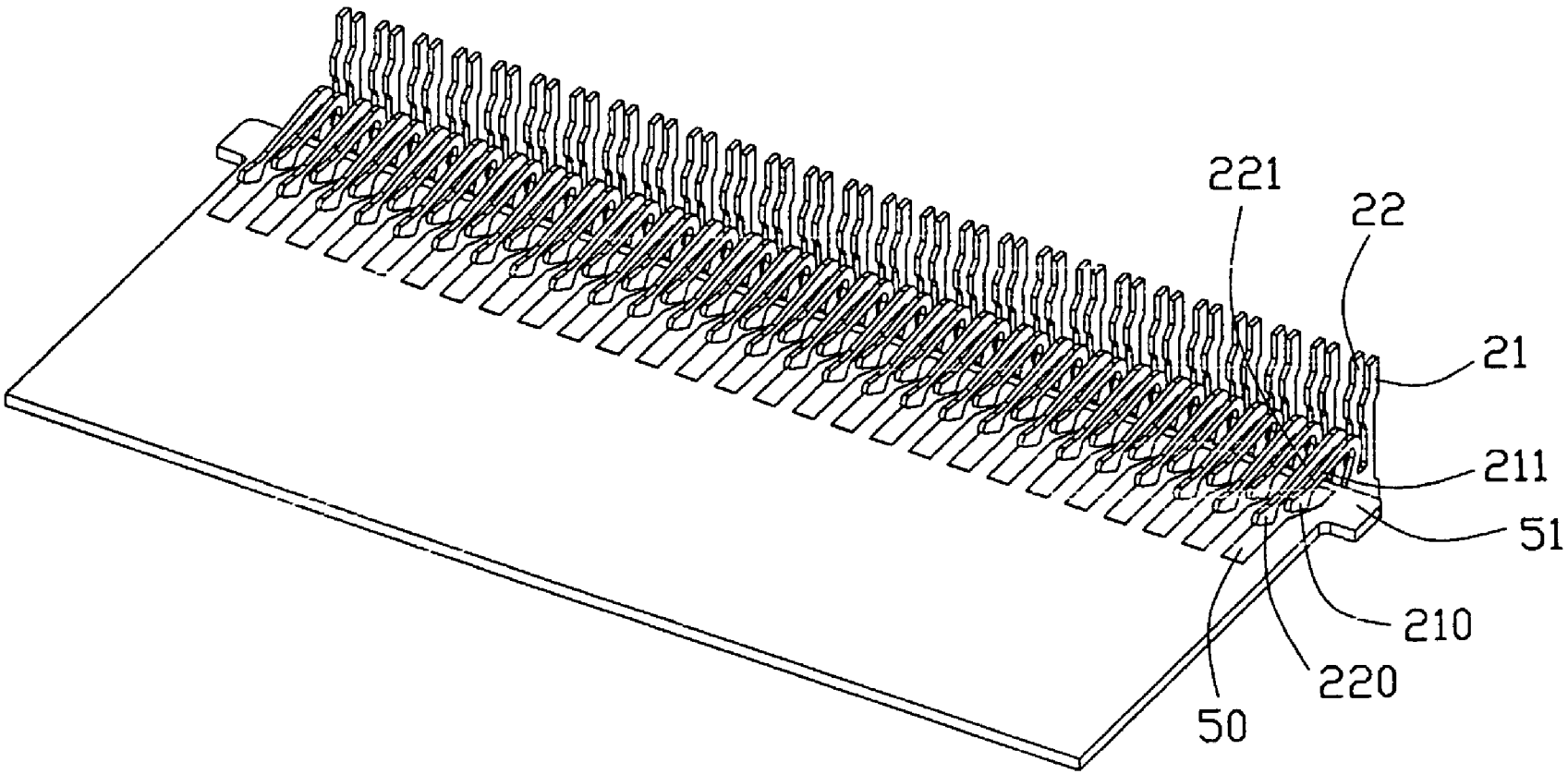

When assembling, the first and second terminals 21, 22 and the latching members 4 are assembled into the housing 1 along a direction opposite to the insertion direction of the sheet-like connection member 5. All the first and second terminals 21, 22 are located between the two latching members 4 and arranged alternatively along the longitudinal direction so as to form a plurality of pairs finally retained in corresponding pairs of the terminal channels 13. Referring to FIGS. 2, 3 and 6, each pair of the terminals consist of one first terminal 21 and one second terminal 22, and the contact portions 210, 220 of each pair are staggered in the insertion direction in order to simultaneously and electrically contact with one contact pad 50 of the sheet-like connection member 5. The solder portions of each pair are also simultaneously connected with one solder pad of a printed circuit board so that the first terminal and second terminal of each pair can transmitted the same signals. Although some portions of the contact pad 50 may be oxidized or covered by dust or other external materials, at least one of the contact portions 210, 220 of each pair can electrically connect with the contact pad 50, and thus this configuration of the electrical connector can efficiently prevent open-circuit taking place.

Referring to FIGS. 2, 5 and 8, the upper wall 11 of housing 1 has a plurality of retaining tubers 100 beside the latching members 4. Each retaining tuber 100 has a latching surface 1001 which extends substantially perpendicular to said insertion direction. When the sheet-like connection member 5 is completely inserted in the inserting cavity 10, the latching surfaces 1001 and the latching surfaces 440 of the latching members 4 are located behind the protrusions 51 so that the sheet-like connection member 5 is restricted in unrespectable movement. The height of latching surface 1001 is configured to be not higher than that of the latching surface 440 in the latching member's 4 released position.

When the pressing member 3 is in the opened position, the sheet-like connection member 5 is inserted into the receiving cavity 10 along the tongue plate 30, and the protrusions 51 extend beyond the latching surfaces 440, 1001 in the insertion direction. Then the pressing member 3 is pushed toward to the closed position, the tongue plate exerts gradually enlarged force on the sheet-like connection member 5. The sheet-like connection member 5 is shifted upward by the tongue plate 30 until the latching surfaces 440, 1001 latch on the protrusions 51, thereby the pressing member 3 is in the closed position. For defining the latching surfaces 440, 1001, the sheet-like connection 5 is stably retained in the housing, and thus a preferable electrical connection of the electrical connector is accordingly achieved.

When the sheet-like connection 5 is required to back toward the opened position, firstly the pressing member 3 is moved back, that is, the tongue plate 30 is pulled out, thereby the sheet-like connection 5 is released downward till the protrusions 51 break off the latching surfaces 440, 1001. Finally the sheet-like connection 5 arrives at the opened position in light of the guidance of the first guiding surfaces 441.

It is noted that the latching members 4 and the retaining tubers 100 are generally called retaining members. In this embodiment, the pressing member 3 is moved along the insertion direction. Of course, the pressing member is also can be configured to be pivotally mounted on the electrical connector, and the conductive terminals also can be changed according to any requirements. In a word, said retaining members can be used any electrical connector for connecting a sheet-like connector but not limited to the electrical connector disclosed above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting with a sheet-like connection member, comprising:

an insulative housing defining an insertion cavity extending along a longitudinal direction of the housing;

a plurality of conductive terminals disposed in the housing and each terminal having a contact beam with a contact portion exposed to the insertion cavity;

a pressing member associated with the housing and movable between an opened position where the sheet-like connection is permitted into the insertion cavity and a closed position where the pressing member urges the sheet-like connection member to electrically connect with the contact portions of the terminals; and a retaining member connected with the housing for latching with the sheet-like connection member;

wherein the retaining member comprises at least one retaining tuber projecting into the insertion cavity and located beside the all contact beams of the terminals.

2. The electrical connector as claimed in claim 1, wherein the retaining member has a pair of latching members respectively mounted to lengthwise ends of the housing, each latching member has a latching beam located at the same side of housing as the contact beams of the terminals.

3. The electrical connector as claimed in claim 2, wherein the latching beam has a projection extending into the insertion cavity and having a latching surface extending perpendicular to an insertion direction of the sheet-like connection member and the longitudinal direction for retaining the sheet-like connection member in its proper position.

4. The electrical connector as claimed in claim 3, wherein the projection has a first guiding surface formed at a certain angle to the latching surface so as to guide the sheet-like connection member being removed out of the housing.

5. The electrical connector as claimed in claim 4, wherein the projection has a second guiding surface formed at a certain angle to the first guiding surface for guiding the sheet-like being inserted into the insertion cavity.

6. The electrical connector as claimed in claim 2, wherein the latching member has a retention beam extending substantially parallel to the latching beam.

7. The electrical connector as claimed in claim 2, wherein the latching member has a solder portion for connecting to a printed circuit board where the electrical connector is mounted.

8. The electrical connector as claimed in claim 1, wherein the retaining tuber has a latching surface extending perpendicular to an insertion direction of the sheet-like connection member and the longitudinal direction for retaining the sheet-like connection member in its proper position.

9. The electrical connector as claimed in claim 1, wherein the retaining tuber integrally projecting from one wall of the housing in which the contact beams of the terminals are received.

10. The electrical connector as claimed in claim 1, wherein the sheet-like connection member is previously urged to electrically connect with the contact portions of the terminals and then latched by the retaining member during the pressing member moving from the opened position to the closed position.

11. The electrical connector as claimed in claim 1, wherein the pressing member is movable along an insertion direction of the sheet-like connection member and comprises a tongue plate inserted into the insertion cavity, a pair of latching arm located two lateral sides of the tongue plate and a base plate connecting the tongue plate and the latching arms together.

12. An electrical connector assembly comprising:

an insulative housing defining an elongated slot along a first direction;

a flexible printed circuit board together with a pressing member inserted into the slot;

a plurality of contacts disposed in the housing and having contact portions extending into the slot and engaged with the flexible printed circuit board in a second direction essentially perpendicular to said first direction; and at least one latching member assembled to the housing and defining a latching claw extending along said second direction to grip a rearward edge of the flexible printed circuit board; wherein the flexible printed circuit board is released from the latching claw only after the pressing member is at least partially withdrawn from the slot to not only disengage the contact portions from the flexible printed circuit board and but also result in a space in the slot available printed circuit board to move in the second direction.

13. The assembly as claimed in claim 12, wherein the rearward edge is located on a lateral enlarged section of the flexible printed circuit board.

14. The assembly as claimed in claim 13, wherein said rearward edge is fully exposed toward an exterior in a third direction perpendicular to both said first and second directions when said flexible printed circuit is not inserted into the slot.

* * * * *